US011657668B2

(12) United States Patent
Liu et al.

(10) Patent No.: US 11,657,668 B2
(45) Date of Patent: May 23, 2023

(54) DRIVING DEVICE, BUCKET AND VENDING MACHINE

(71) Applicant: Shandong New Beiyang Information Technology Co., Ltd., Shandong (CN)

(72) Inventors: Kai Liu, Shandong (CN); Hongze Wei, Shandong (CN); Fengbo Xu, Shandong (CN); Sibo Zhang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 397 days.

(21) Appl. No.: 16/959,080

(22) PCT Filed: Sep. 21, 2018

(86) PCT No.: PCT/CN2018/107069
§ 371 (c)(1),
(2) Date: Jun. 29, 2020

(87) PCT Pub. No.: WO2019/128337
PCT Pub. Date: Jul. 4, 2019

(65) Prior Publication Data

US 2020/0334940 A1 Oct. 22, 2020

(30) Foreign Application Priority Data

Dec. 29, 2017 (CN) ..... 201711474171.8

(51) Int. Cl.
*G07F 11/16* (2006.01)
*G07F 11/24* (2006.01)

(52) U.S. Cl.
CPC ..... *G07F 11/1653* (2020.05); *G07F 11/16* (2013.01); *G07F 11/24* (2013.01)

(58) Field of Classification Search
CPC . F16H 1/20; G07F 11/16; G07F 11/24; G07F 11/42; G07F 11/1653
See application file for complete search history.

(56) References Cited

U.S. PATENT DOCUMENTS 6,520,604 B1 * 2/2003 Yasaka ..... G07F 11/42 312/61
2001/0048000 A1 * 12/2001 Arai ..... G07F 11/62 221/133

(Continued)

FOREIGN PATENT DOCUMENTS

CN 106327679 A 1/2017
CN 107004327 A 8/2017

(Continued)

OTHER PUBLICATIONS

International Search Report dated Dec. 3, 2018, in the International Application No. PCT/CN2018/107069. 4 pages.

*Primary Examiner* — Gene O Crawford
*Assistant Examiner* — Kelvin L Randall, Jr.
(74) *Attorney, Agent, or Firm* — Wilmer Cutler Pickering Hale and Dorr LLP

(57) ABSTRACT

The present disclosure provides a driving device, a bucket and a vending machine. The driving device comprises a base, a motor arranged on the base, a transmission mechanism in transmission connection with the output shaft of the motor and a power output wheel in transmission connection with the transmission mechanism; the transmission mechanism is configured to drive the power output wheel to rotate and to move from a first position to a second position when the output shaft of the motor rotates in a first preset direction; the transmission mechanism is also configured to drive the power output wheel to move from the second position to the first position when the output shaft of the motor rotates in a second preset direction; wherein the first preset direction is opposite to the second preset direction.

17 Claims, 4 Drawing Sheets

(56) References Cited

U.S. PATENT DOCUMENTS

| | | | | |
|---|---|---|---|---|
| 2003/0201275 | A1* | 10/2003 | Tamura | G07F 11/1653<br>221/123 |
| 2005/0056675 | A1* | 3/2005 | Bartolone | G07F 11/68<br>225/2 |
| 2005/0189364 | A1* | 9/2005 | Herzog | G07F 11/1653<br>221/1 |
| 2006/0208851 | A1* | 9/2006 | Tsunoda | G07F 11/58<br>340/572.1 |
| 2020/0043273 | A1* | 2/2020 | Vazquez | G07F 11/165 |

FOREIGN PATENT DOCUMENTS

| | | | | |
|---|---|---|---|---|
| JP | 2000-113307 | A | | 4/2000 |
| JP | 2003085632 | A | * | 3/2003 |
| JP | 2005-018151 | A | | 1/2005 |

* cited by examiner

DRIVING DEVICE, BUCKET AND VENDING MACHINE

CROSS-REFERENCE TO RELATED APPLICATIONS

The present disclosure is a United States national stage application of International Patent Application Number PCT/CN2018/107069, filed on Sep. 21, 2018, which claims priority to Chinese Patent Application No. 201711474171.8, which was filed with the State Intellectual Property Office of the People's Republic of China on Dec. 29, 2017, the entirety of each of which is incorporated herein by reference.

TECHNICAL FIELD

The present disclosure relates to the field of vending equipment, such as a driving device, a bucket and a vending machine.

BACKGROUND

The Vending Machine (VEM) is a machine that can automatically deliver goods according to the coins put in. The vending machine is common for commercial automation. The vending machine is not limited by time or place, and it can save manpower and facilitate transactions.

The vending machine usually comprises a cabinet, and a bucket and multiple goods columns arranged inside the cabinet; the surface of the cabinet is provided with a pickup port, multiple goods columns are configured for placing goods, and the bucket is configured for delivering goods between the goods columns and the pickup port. In order to reduce the cost, a driving device is usually arranged on the bucket and it is configured to provide power for the output of goods for multiple goods columns. However, the driving device of the bucket in the related art is complicated in structure and generally high in manufacturing cost.

SUMMARY

The present disclosure provides a driving device, a bucket and a vending machine, simple in structure and low in manufacturing cost.

In an embodiment, the present disclosure provides a driving device, comprising:

a frame;

a motor arranged on the frame;

a transmission mechanism in transmission connection with the output shaft of the motor; and a power output wheel in transmission connection with the transmission mechanism;

Wherein, the transmission mechanism is configured to drive the power output wheel to rotate and to move from a first position to a second position when the output shaft of the motor rotates in a first preset direction; the transmission mechanism is also configured to drive the power output wheel to move from the second position to the first position when the output shaft of the motor rotates in a second preset direction; wherein, the first preset direction is opposite to the second preset direction.

In an embodiment, the present disclosure provides a bucket, comprising a bucket body and any one of the above-mentioned driving device; the driving device is arranged on the bucket body.

In an embodiment, the present disclosure provides a vending machine, comprising a goods column, a delivery device installed in the goods column, and the bucket mentioned above; the power output wheel in the bucket is configured to be separated from the delivery device in a first position and be coupled with the delivery device in a second position to transmit the power of the motor to the delivery device.

In the figure: 100—driving device; 110—frame; 112—base plate; 113—mounting hole; 114—vertical plate; 116—mounting table; 120—motor; 130—transmission mechanism; 131—intermediate transmission assembly; 132—first rotating shaft; 134—intermediate transmission wheel; 136—motor output wheel; 138—speed reducer; 140—power output wheel; 142—second rotating shaft; 150—swing member; 160—detecting mechanism; 170—one-way transmission assembly; 180—elastic member; 190—first preset direction; 192—second preset direction; 200—bucket; 210—bucket body; 212—inner cavity; 220—opening; 230—fifth preset direction; 300—vending machine; 310—goods column; 312—delivery device.

DETAILED DESCRIPTION OF ILLUSTRATIVE EMBODIMENTS

The technical solutions in the embodiments of the present disclosure will be described as follows with reference to the drawings. The said embodiments are only some of rather than all of the embodiments of the present disclosure.

The following descriptions of embodiments of the present disclosure are not intended to limit the scope of the claimed disclosure, but merely represent some embodiments of the disclosure. Similar numbers and letters refer to similar items in the following drawings. Therefore, once an item is defined in one drawing, such item will not be defined or explained in the subsequent drawings.

In the descriptions of the present disclosure, the words "first" and "second" are only used for distinguishing descriptions, and cannot be understood as indicating or implying relative importance.

Figure 1:
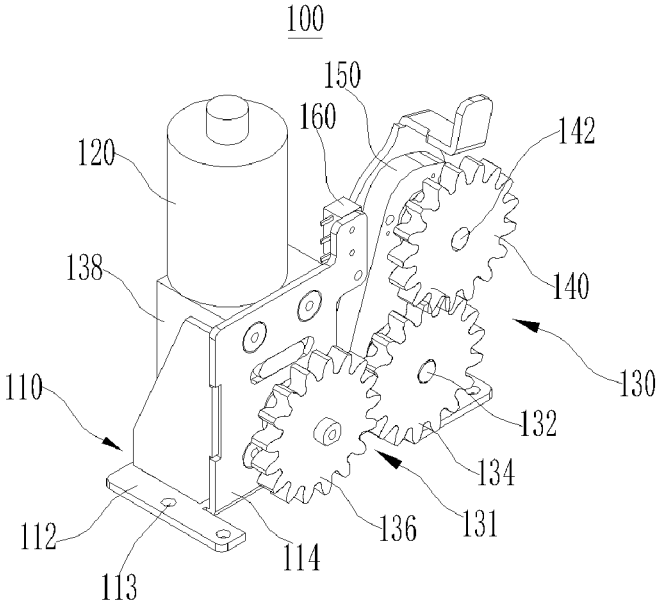
FIG. 1 is a structural view of a driving device from a first angle of view according to an embodiment.
Figure 2:
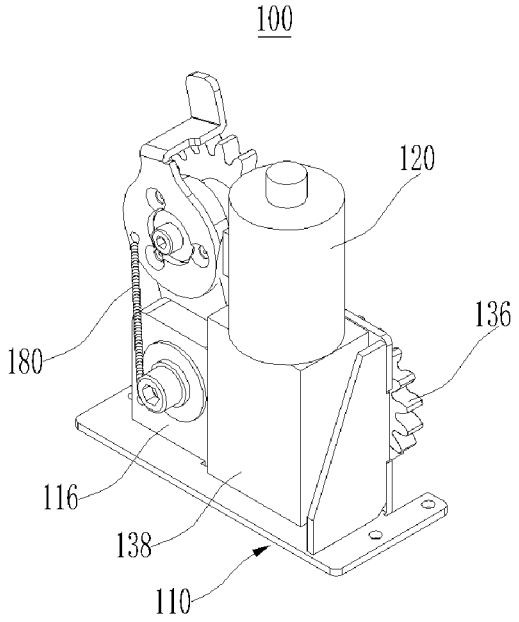
FIG. 2 is a structural view of a driving device from a second angle of view according to an embodiment.
Figure 3:
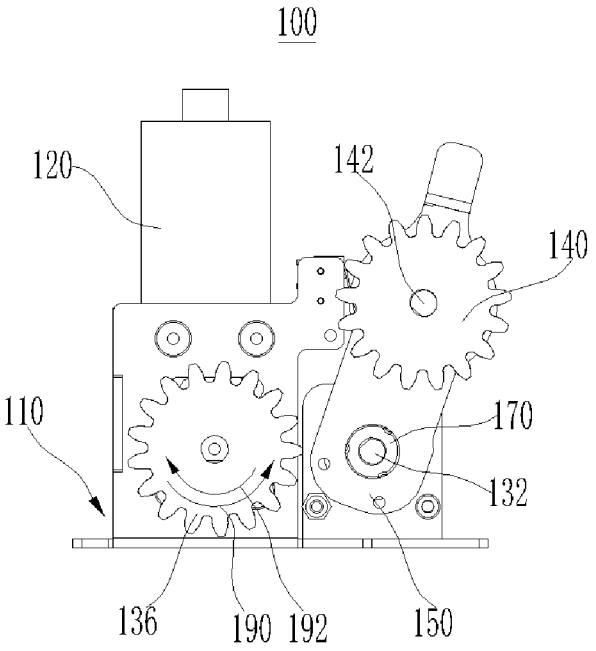
FIG. 3 is a structural view of a driving device from a third angle of view according to an embodiment.

FIG. 1 is a structural view of a driving device 100 from a first angle of view according to an embodiment, FIG. 2 is a structural view of a driving device 100 from a second angle of view according to an embodiment, and FIG. 3 is a structural view of a driving device 100 from a third angle of view according to an embodiment. As shown in FIG. 1-FIG. 3, the embodiment provides a driving device 100, comprising a frame 110, a motor 120 installed on the frame 110, a transmission mechanism 130 rotationally connected to the output shaft of the motor 120, and a power output wheel 140 in transmission connection with the transmission mechanism 130. The transmission mechanism 130 is configured to drive the power output wheel 140 to rotate and to move from a first position to a second position when the output shaft of the motor 120 rotates in a first preset direction 190; the transmission mechanism 130 is also configured to drive the power output wheel 140 to move from the second position to the first position when the output shaft of the motor 120 rotates in a second preset direction 192. In an embodiment, the first preset direction 190 is opposite to the second preset direction 192.

In an embodiment, the frame 110 may comprise a base plate 112, a vertical plate 114, and a mounting table 116. The edge of the base plate 112 is provided with at least two mounting holes 113 for mounting the driving device 100. The vertical plate 114 and the mounting table 116 are respectively connected to the base plate 112. In an embodiment, the vertical plate 114 is roughly rectangular and is formed by folding the base plate 112 upward, and the mounting table 116 is roughly rectangular and fixed on the upper surface of the base plate 112. The motor 120 is installed on the vertical plate 114.

Figure 4:
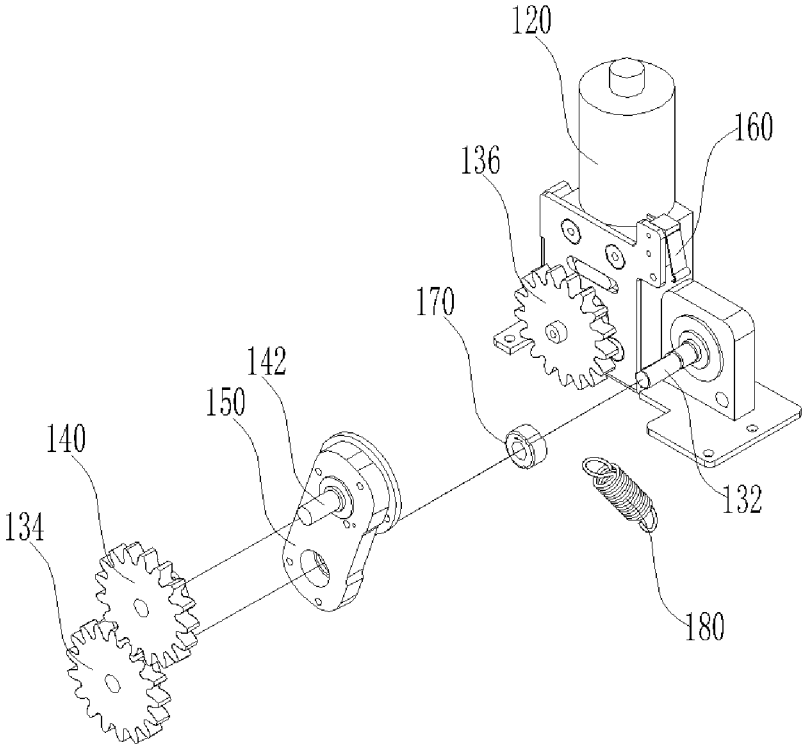
FIG. 4 is an explosive view of a driving device according to an embodiment.

FIG. 4 is an explosive view of a driving device 100 according to an embodiment. As shown in FIG. 1 and FIG. 4, the transmission mechanism 130 comprises a swing member 150, an intermediate transmission assembly 131, and a one-way transmission assembly 170.

The power output wheel 140 is rotationally arranged on the swing member 150, the output shaft of the motor 120 is in transmission connection with the power output wheel 140 through the intermediate transmission assembly 131, and the output shaft of the motor 120 is connected with the swing member 150 through the one-way transmission assembly 170.

When the output shaft of the motor 120 rotates in the first preset direction 190, the one-way transmission assembly 170 is unlocked; namely, the transmission connection between the one-way transmission assembly 170 and the swing member 150 is broken; the power output from the output shaft of the motor 120 cannot be transmitted to the swing member 150 through the one-way transmission assembly 170, the swing member 150 swings in a third preset direction under the action of external force to drive the power output wheel 140 to move from the first position to the second position, and the power of the motor 120 is transmitted to the power output wheel 140 through the intermediate transmission assembly 131 to rotate the power output wheel 140. The relative relationship between the third preset direction and the first preset direction 190 is not specifically limited. For example, when the meshing transmission of spur gears is adopted for the intermediate transmission assembly 131, the third preset direction may be set to be the same as or opposite to the first preset direction 190; when the meshing transmission of bevel gears is adopted for the intermediate transmission assembly 131, an included angle may be set between the third preset direction and the first preset direction 190.

When the output shaft of the motor 120 rotates in the second preset direction 192, the one-way transmission assembly 170 is locked; namely, the one-way transmission assembly 170 is in transmission connection with the swing member 150; the power output from the output shaft of the motor 120 is transmitted to the swing member 150 through the one-way transmission assembly 170, so that the swing member 150 swings in a fourth preset direction under the drive of the motor 120, and the power output wheel 140 is driven to move from the second position to the first position; the fourth preset direction is opposite to the third preset direction.

In an embodiment, the swing member 150 is configured as strip-shaped and provided with arc-shaped structures at both ends. The swing member 150 may be driven by different types of external force to swing in the third preset direction. In the embodiment, the external force may be the combined force of the gravity of the swing member 150 and the acting force of the elastic member 180. The swing member 150 has a tendency to swing in the third preset direction under the action of its own gravity. In an embodiment, the driving device 100 further comprises an elastic member 180; the first end of the elastic member 180 is connected with the frame 110, and the second end of the elastic member 180 is connected with the swing member 150. The elastic member 180 is configured to apply an elastic force to the swing member 150, so that the swing member 150 always has a tendency to swing in the third preset direction. The elastic member 180 may be provided with different structural types as required. In the embodiment, the elastic member 180 may be a tension spring. In other embodiments, the elastic member 180 may also be an elastic rope or a torsion spring. In other embodiments, the external force may be the gravity of the swing member 150 or the acting force of the elastic member 180.

The intermediate transmission assembly 131 may be provided with different structural types as required. In this embodiment, the intermediate transmission assembly 131 may comprise a first rotating shaft 132 and an intermediate transmission wheel 134 fixedly socketed on the first rotating shaft 132. The first rotating shaft 132 is rotationally arranged on the mounting table 116, and the intermediate transmission wheel 134 is transmission connected between the output shaft of the motor 120 and the power output wheel 140. The intermediate transmission wheel 134 may be provided with different structural types as required. In the embodiment, the intermediate transmission wheel 134 may be a gear. In other embodiments, the intermediate transmission wheel 134 may also be a belt wheel.

In an embodiment, the intermediate transmission assembly 131 may further comprise a speed reducer 138 and a motor output wheel 136; the output shaft of the motor 120, the speed reducer 138, the motor output wheel 136 and the intermediate transmission wheel 134 are in transmission connection in turn. In an embodiment, the speed reducer 138 is fixed on one side of the vertical plate 114; the output shaft of the motor 120 is fixedly connected with the input end of the speed reducer 138; the output end of the speed reducer 138 passes through the vertical plate 114 and is fixedly connected with the motor output wheel 136. The motor output wheel 136 may be provided with different structural types as required. In the embodiment, the motor output wheel 136 may be a gear to mesh with the intermediate transmission wheel 134. In other embodiments, the motor output wheel 136 may also be a belt wheel.

The one-way transmission assembly 170 may be provided with different structural types as required. In the embodiment, the one-way transmission assembly 170 comprises a one-way bearing. The inner wall of the one-way bearing is socketed on the first rotating shaft 132, and the outer wall of the one-way bearing is connected with the first end of the swing member 150. In other embodiments, the one-way transmission assembly 170 may also be provided with other structural types such as a ratchet-pawl mechanism.

The power output wheel 140 is installed at the second end of the swing member 150. In an embodiment, the second end of the swing member 150 is provided with a rotatable second rotating shaft 142, and the power output wheel 140 is socketed on the second rotating shaft 142. The power output wheel 140 may be provided with different structural types as required. In the embodiment, the power output wheel 140 may be a gear to mesh with the intermediate transmission wheel 134.

The driving device 100 may further comprise a detecting mechanism 160 and a control mechanism (not shown in the figure). Both the detecting mechanism 160 and the motor 120 are communicatively connected with the control mechanism. The detecting mechanism 160 is configured to detect whether the power output wheel 140 reaches the first position. If the detecting mechanism 160 detected that the power output wheel 140 has reached the first position, a signal will be sent to the control mechanism, and the control mechanism controls the motor 120 to stop rotating according to the signal. In an embodiment, the detecting mechanism 160 comprises a sensor and a detecting member; the sensor is connected with the frame 110, and the detecting member is connected with the power output wheel 140. When the power output wheel 140 reaches the first position under the drive of the motor 120, the detecting member is coupled with the sensor; the sensor sends a signal to the control mechanism, and the control mechanism controls the motor 140 to stop rotating after receiving the signal.

The operating principle and process of the driving device 100 according to the embodiment are as follows:

When it is not necessary to output power, the power output wheel 140 is located at the first position, the output shaft of the motor 120 does not rotate, and the motor output wheel 136, the intermediate transmission wheel 134 and the power output wheel 140 are all still; the swing member 150 has a tendency to swing in a third preset direction under its own gravity and the action of the elastic member 180.

When it is necessary to output power, the output shaft of the motor 120 rotates in the first preset direction 190 to drive the motor output wheel 136 to rotate in the first preset direction 190, and thus to drive the intermediate transmission wheel 134 to rotate in the second preset direction 192, so that the power output wheel 140 can be driven to rotate in the first preset direction 190. At the same time, the one-way transmission assembly 170 is unlocked, and the swing member 150 swings in the third preset direction under its own gravity and the action of the elastic member 180, so the swing member 150 drive the power output wheel 140 to move to the second position from the first position.

When it is necessary to stop outputting power, the output shaft of the motor 120 rotates in the second preset direction 192 to drive the motor output wheel 136 to rotate in the second preset direction 192, and thus to drive the intermediate transmission wheel 134 to rotate in the first preset direction 190, so that the first rotating shaft 132 can be driven to rotate in the first preset direction 190; at the point, since the one-way transmission assembly 170 is locked, the swing member 150 will swing in the fourth preset direction under the drive of the first rotating shaft 132, so the swing member 150 drive the power output wheel 140 to move from the second position to the first position; the motor 120 will stop rotating when the power output wheel 140 reaches the first position.

Referring to FIG. 3, in the embodiment, the first preset direction 190 is the counter-clockwise direction, and the second preset direction 192 is the clockwise direction. The first position is the lifting position and the second position is the lowering position (i.e. the first position is higher than the second position). In other embodiments, for example, when the motor 120 is directly connected to the first rotating shaft 132, the first preset direction 190 may also be the clockwise direction and the second preset direction 192 may also be the counter-clockwise direction. In an embodiment, for example, when the driving device 100 is integrally inverted, the first position may also be the lowering position, and the second position may also be the lifting position (i.e., the first position is lower than the second position).

The driving device 100 comprises a frame 110, a motor 120 installed on the frame 110, a transmission mechanism 130 in transmission connection with the output shaft of the motor 120, and a power output wheel 140 in transmission connection with the transmission mechanism 130. In an embodiment, the transmission mechanism 130 is configured to drive the power output wheel 140 to rotate and to move from the first position to the second position when the output shaft of the motor 120 rotates in the first preset direction 190; the transmission mechanism 130 is also configured to drive the power output wheel 140 to move from the second position to the first position when the output shaft of the motor 120 rotates in the second preset direction 192; the first preset direction 190 is opposite to the second preset direction 192. The driving device 100 can realize the rotation and movement of the power output wheel 140 at the same time through the motor 120, and it is simple in structure and low in manufacturing cost, effectively making up for the defects of related technologies.

In an embodiment, the driving device 100 can be installed in any kind of equipment involving transmission wheels as required, such as the bucket 200 of the vending machine 300.

Figure 5:
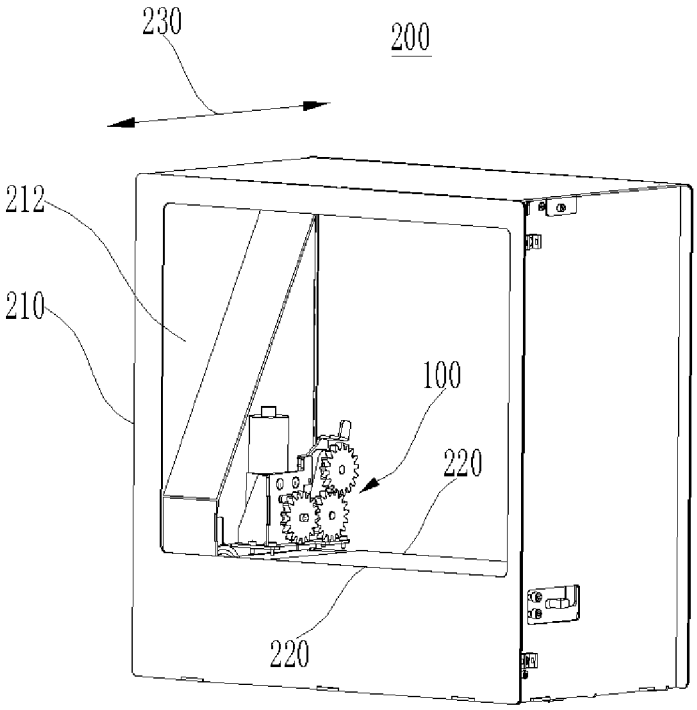
FIG. 5 is a structural view of a bucket according to an embodiment.

FIG. 5 is a structural view of the bucket 200 according to an embodiment. As shown in FIG. 5, in the embodiment it provides a bucket 200, comprising a bucket body 210 and the above-mentioned driving device 100; the bucket body 210 is designed as a frame structure and is roughly rectangular, provided with an inner cavity 212 and two ports 220 connected to the inner cavity 212 respectively; two ports 220 are configured at an interval in a fifth preset direction 230. The driving device 100 is installed in the bucket body 210 and adjacent to one port 220. With the above-mentioned driving device 100, the bucket 200 can effectively reduce the number of motors 120, and it is simple in structure and low in manufacturing cost, effectively making up for the defects of related technologies.

In an embodiment, the bucket 200 can be installed in any equipment that needs to contain and transport goods as required, such as vending machine 300, goods transport equipment or goods processing equipment.

Figure 6:
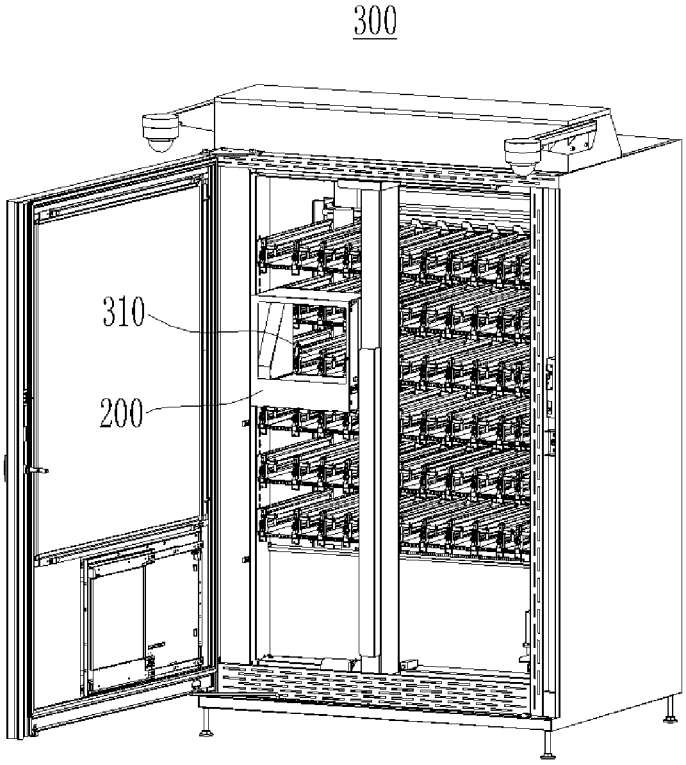
FIG. 6 is a structural view of a vending machine according to an embodiment.
Figure 7:
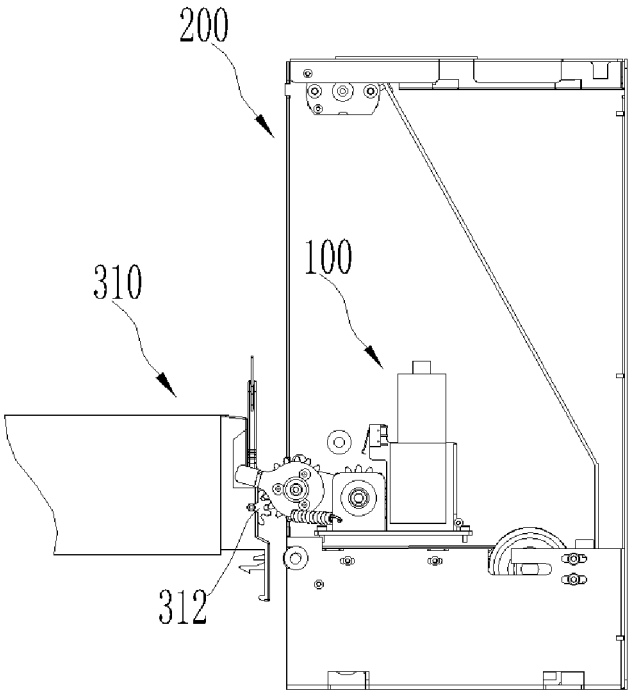
FIG. 7 is a schematic diagram for a state when a power output wheel is in transmission connection with a delivery device according to an embodiment.
Figure 8:
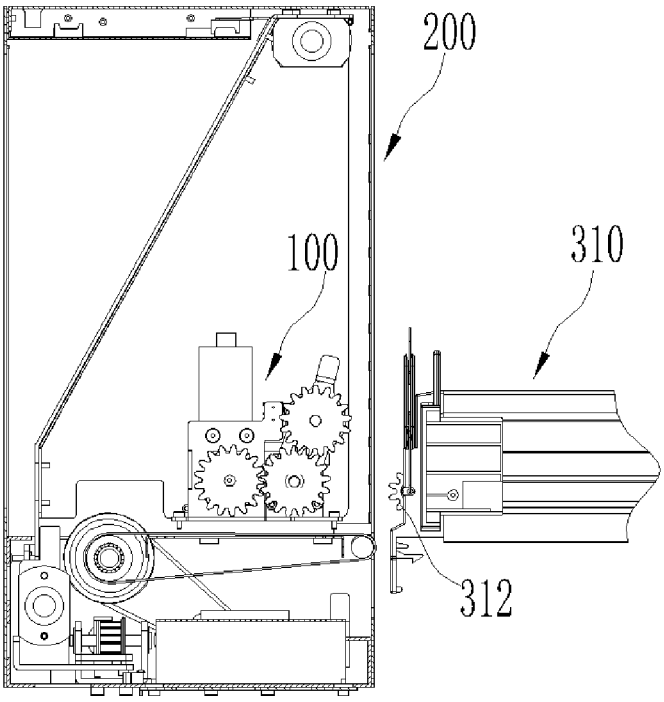
FIG. 8 is a schematic diagram for a state when a power output wheel is separated from a delivery device according to an embodiment.

FIG. 6 is a structural view of the vending machine 300 according to an embodiment; FIG. 7 is a schematic view for a state when the power output wheel 140 is in transmission connection with the delivery device 312 according to an embodiment; FIG. 8 is a schematic view for a state when the power output wheel 140 is separated from the delivery device 312 according to an embodiment. As shown in FIG. 6-FIG. 8, in the embodiment it provides a vending machine 300, comprising a goods column 310, a delivery device 312 installed in the goods column 310, and the above-mentioned bucket 200. Multiple goods columns 310 arranged side by side are provided; each goods column 310 is provided with a delivery device 312, and the delivery device 312 is configured to deliver the goods in the goods column 310. When the bucket 200 is opposite to one of the multiple goods columns 310, the power output wheel 140 of the driving device 100 of the bucket 200 moves from the first position to the second position so that the power output wheel 140 can be coupled with the delivery device 312 of the goods column 310 at the second position to transmit the power of the motor 120 of the driving device 100 to the delivery device 312, and thus to drive the delivery device 312 to convey goods. When it is not necessary to convey goods, the power output wheel 140 of the driving device 100 moves from the second position to the first position, the power output wheel 140 is separated from the delivery device 312, and the delivery device 312 stops conveying.

The vending machine 300 is provided with the above-mentioned bucket 200, with a small number of motors 120, and it is simple in structure and low in manufacturing cost, effectively making up for the defects of related technologies.

The above embodiments are only those of the present disclosure, and not intended to limit the present disclosure.

What is claimed is:

1. A driving device for a bucket of a vending machine, comprising:

a frame;

a motor arranged on the frame;

a transmission mechanism in transmission connection with the an output shaft of the motor; and a power output wheel in transmission connection with the transmission mechanism;

wherein the transmission mechanism is configured to drive the power output wheel to rotate and to move from a first position to a second position when the output shaft of the motor rotates in a first preset direction;

wherein the transmission mechanism is also configured to drive the power output wheel to move from the second position to the first position when the output shaft of the motor rotates in a second preset direction;

wherein the first preset direction is opposite to the second preset direction;

wherein the transmission mechanism comprises a swing member, an intermediate transmission assembly and a one-way transmission assembly;

wherein the power output wheel is rotationally arranged on the swing member, the output shaft of the motor is in transmission connection with the power output wheel through the intermediate transmission assembly, and the output shaft of the motor is connected with the swing member through the one-way transmission assembly;

when the output shaft of the motor rotates in the first preset direction, the one-way transmission assembly is unlocked, the swing member swings in a third preset direction under the action of external force to drive the power output wheel to move from the first position to the second position, and the power of the motor is transmitted to the power output wheel through the intermediate transmission assembly to rotate the power output wheel;

when the output shaft of the motor rotates in the second preset direction, the one-way transmission assembly is locked, and the power of the motor is transmitted to the swing member through the one-way transmission assembly, so that the swing member swings in a fourth preset direction under the drive of the motor, and the power output wheel is driven to move from the second position to the first position;

wherein the third preset direction is opposite to the fourth preset direction.

2. The driving device according to claim 1, wherein the output shaft of the motor is connected with the swing member through the one-way transmission assembly, including the output shaft of the motor, the intermediate transmission assembly, the one-way transmission assembly and the swing member, which are connected in turn.

3. The driving device according to claim 2, wherein the one-way transmission assembly comprises a one-way bearing.

4. The driving device according to claim 3, wherein the intermediate transmission assembly comprises a first rotating shaft and an intermediate transmission wheel fixedly socketed on the first rotating shaft, wherein the first rotating shaft is rotationally arranged on the base, the inner wall of the one-way bearing is socketed on the first rotating shaft, and the outer wall of the one-way bearing is connected with the swing member, and wherein the intermediate transmission wheel is in transmission connection between the output shaft of the motor and the power output wheel.

5. The driving device according to claim 4, further comprising a second rotating shaft, wherein the second rotating shaft is rotationally arranged on the swing member, and wherein the power output wheel is socketed on the second rotating shaft.

6. The driving device according to claim 1, wherein the swing member has a tendency to swing in a third preset direction under the action of its own gravity.

7. The driving device according to claim 1, further comprising an elastic member, wherein a first end of the elastic member is connected with the base, a second end of the elastic member is connected with the swing member, and the elastic member is configured to apply elastic force to the swing member so that the swing member has a tendency to swing in a third preset direction.

8. The driving device according to claim 1, further comprising a detecting mechanism, wherein the detecting mechanism is configured to detect whether the power output wheel reaches the first position.

9. A bucket, comprising a bucket body and a driving device arranged on the bucket body, wherein the driving device, comprises:

a frame;

a motor arranged on the frame;

a transmission mechanism in transmission connection with an output shaft of the motor; and a power output wheel in transmission connection with the transmission mechanism;

wherein the transmission mechanism is configured to drive the power output wheel to rotate and to move from a first position to a second position when the output shaft of the motor rotates in a first preset direction;

wherein the transmission mechanism is also configured to drive the power output wheel to move from the second position to the first position when the output shaft of the motor rotates in a second preset direction;

wherein the first preset direction is opposite to the second preset direction;

wherein the transmission mechanism comprises a swing member, an intermediate transmission assembly and a one-way transmission assembly;

wherein the power output wheel is rotationally arranged on the swing member, the output shaft of the motor is in transmission connection with the power output wheel through the intermediate transmission assembly, and the output shaft of the motor is connected with the swing member through the one-way transmission assembly;

when the output shaft of the motor rotates in the first preset direction, the one-way transmission assembly is unlocked, the swing member swings in a third preset direction under the action of external force to drive the power output wheel to move from the first position to the second position, and the power of the motor is transmitted to the power output wheel through the intermediate transmission assembly to rotate the power output wheel;

when the output shaft of the motor rotates in the second preset direction, the one-way transmission assembly is locked, and the power of the motor is transmitted to the swing member through the one-way transmission assembly, so that the swing member swings in a fourth preset direction under the drive of the motor, and the power output wheel is driven to move from the second position to the first position;

wherein the third preset direction is opposite to the fourth preset direction.

10. The bucket according to claim 9, wherein the output shaft of the motor is connected with the swing member through the one-way transmission assembly, including the output shaft of the motor, the intermediate transmission assembly, the one-way transmission assembly and the swing member, which are connected in turn.

11. The bucket according to claim 10, wherein the one-way transmission assembly comprises a one-way bearing.

12. The bucket according to claim 11, wherein the intermediate transmission assembly comprises a first rotating shaft and an intermediate transmission wheel fixedly socketed on the first rotating shaft; the first rotating shaft is rotatably arranged on the base, the inner wall of the one-way bearing is socketed on the first rotating shaft, and the outer wall of the one-way bearing is connected with the swing member; the intermediate transmission wheel is in transmission connection between the output shaft of the motor and the power output wheel.

13. The bucket according to claim 12, wherein the driving device further comprises a second rotating shaft; the second rotating shaft is rotatably arranged on the swing member, and the power output wheel is socketed on the second rotating shaft.

14. The bucket according to claim 9, wherein the swing member has a tendency to swing in a third preset direction under the action of its own gravity.

15. The bucket according to claim 9, wherein the driving device further comprises an elastic member; a first end of the elastic member is connected with the base, a second end of the elastic member is connected with the swing member, and the elastic member is configured to apply elastic force to the swing member so that the swing member has a tendency to swing in a third preset direction.

16. The bucket according to claim 9, further comprising a detecting mechanism; the detecting mechanism is configured to detect whether the power output wheel reaches the first position.

17. A vending machine, comprising a goods column, a delivery device installed in the goods column, and a bucket, wherein the power output wheel in the bucket is configured to be separated from the delivery device in a first position and be coupled with the delivery device in a second position to transmit the power of the motor to the delivery device, wherein the bucket comprises a bucket body and a driving device arranged on the bucket body, wherein the driving device, comprises:

a frame;

a motor arranged on the frame;

a transmission mechanism in transmission connection with an output shaft of the motor; and a power output wheel in transmission connection with the transmission mechanism, wherein the transmission mechanism is configured to drive the power output wheel to rotate and to move from a first position to a second position when the output shaft of the motor rotates in a first preset direction; the transmission mechanism is also configured to drive the power output wheel to move from the second position to the first position when the output shaft of the motor rotates in a second preset direction;

wherein the first preset direction is opposite to the second preset direction;

wherein the transmission mechanism comprises a swing member, an intermediate transmission assembly and a one-way transmission assembly;

wherein the power output wheel is rotationally arranged on the swing member, the output shaft of the motor is in transmission connection with the power output wheel through the intermediate transmission assembly, and the output shaft of the motor is connected with the swing member through the one-way transmission assembly;

when the output shaft of the motor rotates in the first preset direction, the one-way transmission assembly is unlocked, the swing member swings in a third preset direction under the action of external force to drive the power output wheel to move from the first position to the second position, and the power of the motor is transmitted to the power output wheel through the intermediate transmission assembly to rotate the power output wheel;

when the output shaft of the motor rotates in the second preset direction, the one-way transmission assembly is locked, and the power of the motor is transmitted to the swing member through the one-way transmission assembly, so that the swing member swings in a fourth preset direction under the drive of the motor, and the power output wheel is driven to move from the second position to the first position;

wherein the third preset direction is opposite to the fourth preset direction.

* * * * *